US008146376B1

(12) United States Patent
Williams et al.

(10) Patent No.: US 8,146,376 B1
(45) Date of Patent: Apr. 3, 2012

(54) SYSTEM AND METHODS FOR ACTIVELY CONTROLLING AN HVAC SYSTEM BASED ON AIR CLEANING REQUIREMENTS

(75) Inventors: Stephen Williams, Waunakee, WI (US); Marwan E. Estiban, Madison, WI (US); Jameson P. Gavin, Madison, WI (US)

(73) Assignee: Research Products Corporation, Madison, WI (US)

( * ) Notice: Subject to any disclaimer, the term of this patent is extended or adjusted under 35 U.S.C. 154(b) by 362 days.

(21) Appl. No.: 12/353,852

(22) Filed: Jan. 14, 2009

Related U.S. Application Data

(60) Provisional application No. 61/020,892, filed on Jan. 14, 2008.

(51) Int. Cl.
*F25D 17/00* (2006.01)
*F24F 7/00* (2006.01)

(52) U.S. Cl. ..... 62/157; 62/180; 62/231; 236/46 C; 236/49.3

(58) Field of Classification Search ..... 62/157, 62/158, 180, 186, 231; 236/46 C, 49.3; 454/256, 454/258

See application file for complete search history.

(56) References Cited

U.S. PATENT DOCUMENTS

| | | | | |
|---|---|---|---|---|
| 4,072,800 | A | 2/1978 | Gammer | |
| 4,191,917 | A | 3/1980 | Brown et al. | |
| 4,391,883 | A | 7/1983 | Williamson et al. | |
| 4,838,482 | A | 6/1989 | Vogelzang | |
| 5,547,017 | A | 8/1996 | Rudd | |
| 6,431,268 | B1 | 8/2002 | Rudd | |
| 6,988,671 | B2 | 1/2006 | DeLuca | |
| 2004/0253918 | A1 | 12/2004 | Ezell et al. | |
| 2006/0004492 | A1 | 1/2006 | Terlson et al. | |
| 2006/0158051 | A1 * | 7/2006 | Bartlett et al. | 310/62 |
| 2006/0172182 | A1 | 8/2006 | Barton et al. | |
| 2007/0056299 | A1 | 3/2007 | Shankweiler | |

* cited by examiner

*Primary Examiner* — Marc Norman
(74) *Attorney, Agent, or Firm* — Boardman & Clark LLP

(57) ABSTRACT

An active air cleaning controller is connected to a forced air heating, ventilation and air conditioning (HVAC) system. The active air cleaning controller uses call signals from a thermostat to the HVAC system and/or sensor signals to determine when, and for how long, the blower of the HVAC system has been active and whether to independently activate the blower. The active air cleaning controller uses at least the collected information regarding the blower run time to determine when to activate the blower, in addition to its use within the HVAC system, to cycle and thus clean the air in a living environment independently of call signals used to activate heating and/or cooling functions of the HVAC system.

17 Claims, 9 Drawing Sheets

SYSTEM AND METHODS FOR ACTIVELY CONTROLLING AN HVAC SYSTEM BASED ON AIR CLEANING REQUIREMENTS

This application claims priority to U.S. Provisional Application 61/020,892, filed Jan. 14, 2008, which is incorporated herein by reference in its entirety.

BACKGROUND

1. Field of the Invention

This invention is directed to an active air cleaning controller for an HVAC system.

2. Background of the Invention

A typical forced-air heating, ventilation and air conditioning (HVAC) system may have a series of ducts that collect air from a living environment and that supply the collected air to an air cleaner, a blower, and a heating unit and/or cooling unit before distributing the conditioned air back to the living environment. In HVAC systems that use an air cleaner, the air cleaner removes particles and/or contaminants from the air. This can improve the quality of the air for people in the living environment serviced by the HVAC system.

In many cases, cleaned air provides substantial advantages for the people in the living environment serviced by the HVAC system. If, for example, the HVAC system services a house inhabited by one or more persons with pollen allergies, the HVAC system may employ an air cleaner that is particularly effective at removing pollen from the air. If the HVAC system is being supplied in part or in whole by air from the outside environment, removing pollen from the air before injecting the air into the living environment is clearly advantageous.

Typically, HVAC systems are designed to provide or circulate air that has been conditioned for a certain temperature range. When a thermostat determines that the temperature of the air in the living environment has fallen or risen outside of a desired temperature range, the thermostat outputs a call signal to a controller of the HVAC system to request that the HVAC system provide air to the living environment that has been heated or cooled to raise or lower the temperature of the living environment, respectively. To do so, the HVAC system will pull in air either from the living environment and/or from outside the environment and heat or cool that air as needed. If the HVAC has an air cleaner in line with the air return ducts, the air that is being heated or cooled will also have passed through the air cleaner and been cleaned.

SUMMARY OF THE DISCLOSED EMBODIMENTS

In the above-described scenario, as long as the air is circulating through the HVAC system, the air will also be cleaned and/or filtered. However, in this scenario, the air is circulated through the HVAC system, and thus is cleaned, only when the HVAC system is otherwise heating or cooling the living environment. If there is no call for heating or cooling from the thermostat, there is no available process for supplying cleaned air. During periods when the temperature of the living environment (at least around the thermostat) stays within the desired temperature range, there may not be a requirement to heat or cool the living environment. As a result, the air of the living environment may go uncleaned for an undesirably long period of time.

As stated above, a conventional HVAC system supplies cleaned air to the living environment only in response to a call for heated or cooled air from the thermostat. Often, there is a need for cleaned air without a need to heat or cool the environment. If, for instance, a person present in the living environment is smoking, the smoke-filled air will not be pulled through the HVAC system, and thus the air cleaner, unless the environment is above or below the desired temperature range such that a heating or cooling signal has been output by the thermostat to the HVAC system controller.

To deal with this problem, some thermostats have a "fan-on" setting. In this case, the HVAC system can be set to continuously cycle air and/or the "fan-on" setting can be manually cycled to turn the fan or blower of the HVAC system on and then off as desired by an occupant of the conditioned living space. In the above-mentioned smoking situation, this may be a satisfactory solution. The "fan on" setting typically leaves the HVAC blower running regardless of the need to heat or cool the air. In this case, the air will be continuously cleaned as it is pulled through the air cleaner.

However, the "fan on" setting of the thermostat nevertheless requires user intervention to either turn on or turn off the HVAC fan or blower. This means that the end user must be aware of the initial need to clean the air and also when such a need is no longer present. Alternatively, the fan or blower could be left on indefinitely. However, when neither heating, cooling nor cleaning is needed or desired, this wastes energy and adds unnecessary usage time to the HVAC components.

It should be appreciated that the term "air cleaner" may include an air cleaner, an air filter and/or any other known or later-developed device usable to remove particulate matter from an air stream.

This invention provides an air cleaning controller that actively monitors how much air cleaning has occurred in a given time period.

This invention separately provides an air cleaning controller that monitors how long an HVAC blower has run over a given time period and instructs the HVAC system to run the blower when the air cleaning controller determines the blower has not run long enough over the given time period.

This invention separately provides an air cleaning controller that is electrically connected between a thermostat or a zone panel and a controller of a forced-air heating, ventilation and air conditioning (HVAC) system.

This invention separately provides an active air cleaning control system that includes one or more sensors that monitor air quality and output call signals based on the detected air quality to a controller of an HVAC to controllably activate and/or deactivate a fan or blower of the HVAC system.

This invention separately provides an active air cleaning controller that monitors filter and/or air cleaner life.

This invention separately provides an active air cleaning controller that notifies a user when a filter and/or an air cleaner has reached or nearly reached the end of its life span.

This invention separately provides an interactive system that allows a user to select the level and type of air cleaning desired.

By monitoring various elements of the HVAC system and the accompanying environment, the active air cleaning controller determines how much air has been passed through an air cleaner in a given period of time and/or what the current environmental needs for air cleaning may be (e.g., the time or the percentage of time in a given period in which air has passed through an air cleaner). The time period and/or the environment conditions over which the air cleaning controller measures air filtering can be user selectable or set to a default value.

In various exemplary embodiments of an active air cleaning controller according to this invention, the active air cleaning controller is connected in series with the HVAC blower call line and in parallel with the call lines for any other elements. In such exemplary embodiments, the active air cleaning controller is able to monitor the status of each call line between the thermostat and the HVAC controller. The active air cleaning controller uses these call lines to determine the run time of the HVAC blower. In such exemplary embodiments, the active air cleaning controller is able to relay or initiate a call on the blower call line if there is no call presently on the blower call line and the active air cleaning controller determines that the blower should be activated for air filtering.

In various other exemplary embodiments of an active air cleaning controller according to this invention, the active air cleaning controller is connected in parallel to some or all of the available call lines between the thermostat and the HVAC controller. In such exemplary embodiments, the active air cleaning controller is able to monitor the status of each such call line between the thermostat and the HVAC. The active air cleaning controller uses these call lines to determine the run time of the HVAC blower and to initiate a call on the blower call line if there is no call presently on the line and the active air cleaning controller determines that the blower should be activated for air cleaning.

In still other various exemplary embodiments of an active air cleaning controller according to this invention, the active air cleaning controller has sensors in one or more supply ducts, in one or more return ducts and/or at one or more locations in the living environment. The active air cleaning controller uses these sensor(s) to monitor the air quality of the living environment. These sensor(s) may be designed to measure pollutants, allergens, irritants and/or any other desired aspect of air quality. The measurements are used by the active air cleaning controller to determine if air cleaning is needed or desired. If air cleaning is needed or desired, and the blower of the HVAC system is not currently running, the active air cleaning controller can initiate a blower call on the blower call line of the HVAC controller to cause the HVAC controller to activate the HVAC blower.

In various exemplary embodiments of an active air cleaning controller according to this invention, the active air cleaning controller uses a replaceable filter and includes one or more sensors that measure the approximate age, amount of use and/or effectiveness of the replaceable filter. These sensors may include a timer, pressure sensors that measure pressure drop across the filter, an airflow measuring sensor, a scale that measures filter mass, an optical sensor, a particle counting sensor, an ohmmeter, an ultrasonic sensor and/or any other known or later-developed sensor usable for measuring the approximate age, amount of use and/or effectiveness of the filter. The active air cleaning controller uses the information from the sensor(s) to determine whether or not the replaceable filter needs to be replaced. The sensor(s) may communicate with the active air cleaning controller using any suitable known or later-developed method, such as, for example, RF communication or any other known or later-developed wired or wireless communication method.

In various exemplary embodiments, if the active air cleaning controller determines that the replaceable filter needs to be replaced, a notification, such as a warning message, a warning light and/or an audible alarm, will be activated. In various exemplary embodiments, the active air cleaning controller will change the parameters that it uses to control the HVAC blower and/or to determine the filter's age, amount of use and/or effectiveness according to the type of filter being used. The active air cleaning controller can either be told by the user what type of filter is being used, or the active air cleaning controller can automatically determine the type of filter being used.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

DETAILED DESCRIPTION OF EXEMPLARY EMBODIMENTS

The following description of various exemplary embodiments of HVAC systems assumes that all components of the HVAC systems are working properly. As such, it is assumed that a call usable to activate any particular component of the HVAC system results in that component successfully being activated. Although various exemplary embodiments of an active air cleaning controller according to this invention may include sensors or the like for positively confirming an active component, various other exemplary embodiments will assume an active component by the presence of an active call signal.

Figure 1:
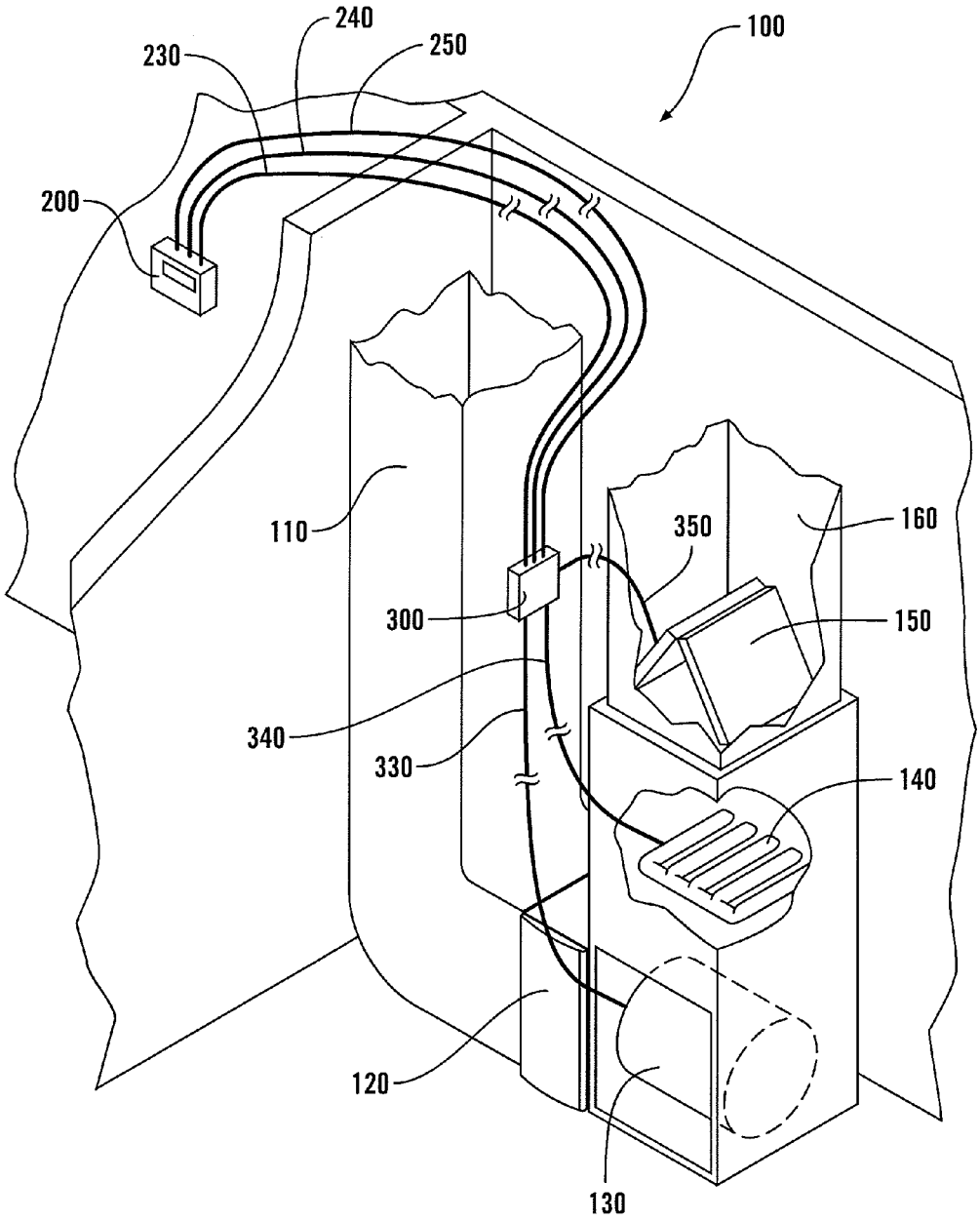
FIG. 1 is a schematic view of an exemplary embodiment of a conventional heating, ventilation and air conditioning system.

FIG. 1 shows an exemplary embodiment of a conventional heating, ventilation and air conditioning (HVAC) system. As shown in FIG. 1, the HVAC system 100 has a return duct 110 that is connected to the local environment and/or the outside environment. The return duct 110 provides source air, i.e., air to be conditioned, to the rest of the HVAC system 100. When the blower 130 is active, it pulls air from the living environment and/or the outside environment into the return duct 110. An air cleaning unit 120 is located between the blower 130 and the return duct 110. The air cleaning unit 120 filters or otherwise cleans the air. The blower 130 pulls air into the return duct 110 and through the air cleaning unit 120, before pushing the air to the rest of the HVAC system 100.

The blower 130 pushes the cleaned air past a heating unit 140 and/or a cooling unit 150 and into a supply duct 160. The heating unit 140 and the cooling unit 150 are activated to heat and cool the air, respectively, depending on the needs of the local environment, as determined by a thermostat 200 that is connected to an HVAC controller 300.

The thermostat 200 is generally placed in the local environment to monitor the temperature conditions and provide information to, and receive settings from, a user. The connections between the thermostat 200 and HVAC controller 300 can include a blower call line 230, which carries call signals to activate the blower 130; a heating unit call line 240, which carries call signals to activate the heating unit 140; and/or a cooling unit call line 250, which carries call signals to activate the cooling unit 150. The HVAC controller 300 is in turn connected to the blower 130 by a control line 330, the heating unit 140 by a control line 340, and/or the cooling unit 150 by a control line 350. In response to a blower call received on the blower call line 230, the HVAC controller 300 will activate the blower 130 via the control line 330. Similarly, the HVAC controller 300 will activate the heating unit 140 via the control line 340 in response to a heating call signal on the heating unit call line 240 and will activate the cooling unit 150 via the control line 350 in response to a cooling signal on the cooling unit call line 250. Additionally, the HVAC controller 300 will activate the blower 130 via the control line 330 in response to a call for heating or cooling on the heating or cooling unit call lines 240 or 250, respectively.

When the thermostat 200 determines that the local environment is too cold, i.e., that the current temperature is below a user-defined limit, the thermostat 200 will send a heating call across the heating unit call line 240 and may send a blower call across the blower call line 230. In response to these calls, the HVAC controller 300 activates the heating unit 140 and the blower 130 via the control lines 340 and 330, respectively. It should be appreciated that it may not be necessary for the thermostat 200 to send a blower call across the blower call line 230 in addition to the heating call across the heating unit call line 240, as the HVAC controller 300 may be designed to respond to the heating call by turning on both the heating unit 140 and the blower 130. In response to the active signals on the control lines 330 and 340 received from the HVAC controller 300, the blower 130 will pull air into the return duct 110 and through the air cleaning unit 120 and will push the cleaned air past the active heating unit 140 and the inactive cooling unit 150 before the heated air is supplied to the local environment through the supply duct 160. The air is cleaned as it passes through the air cleaning unit 120 and warmed as it passes by the heating unit 140.

The above-described process will provide heated and cleaned air to the local environment. If the thermostat 200 had determined that the local temperature had instead risen above a user-defined limit, the thermostat 200 would have at least sent a cooling call signal to the HVAC controller 300 on the cooling unit call line 250 and may have sent a blower call signal on the blower call line 230. In response to these calls, the HVAC controller 300 would have activated the cooling unit 150 and the blower 130 via the control lines 350 and 330, respectively. In this case, the cooling unit 150, rather than the heating unit 140, is active when the cleaned air passes by on its way to the supply duct 160. Again, a separate call signal on the blower call line 230 may not have been necessary. Again, the air supplied through the supply duct 160 is cleaned via its passage through the air cleaning unit 120 before it is conditioned by the HVAC system 100. If, however, the thermostat 200 determines that the temperature is neither above nor below the user defined limits, i.e. the current temperature is inside the desired range, there will be no heating, cooling or blower call signals sent to the HVAC controller 300 from the thermostat 200. In this case, the blower 130 will not be turned on and no air will be pulled through the air cleaning unit 120.

It should be appreciated that the thermostat 200 may have only one defined temperature limit combined with a switch or setting to select whether that limit is the upper or lower limit. In this situation, the thermostat 200 is generally set to a heating or cooling mode and the undefined temperature threshold is considered to be plus or minus infinity, respectively.

It should also be appreciated that the thermostat 200 may have a "fan on" setting. If the user selects a "fan on" setting on the thermostat 200, thermostat 200 will send a call to the HVAC controller 300 on the blower call line 230. In response to the call, the HVAC controller 300 will activate the blower 130 via the control line 330. The blower 130 will pull air into the return duct 110 and through the air cleaning unit 120 before pushing the air past the heating and cooling units 140 and 150. The cleaned air is supplied to the living environment through the supply duct 160. If the temperature in the living environment is within the neutral range, the cleaned air is supplied having been neither heated nor cooled.

Figure 2:
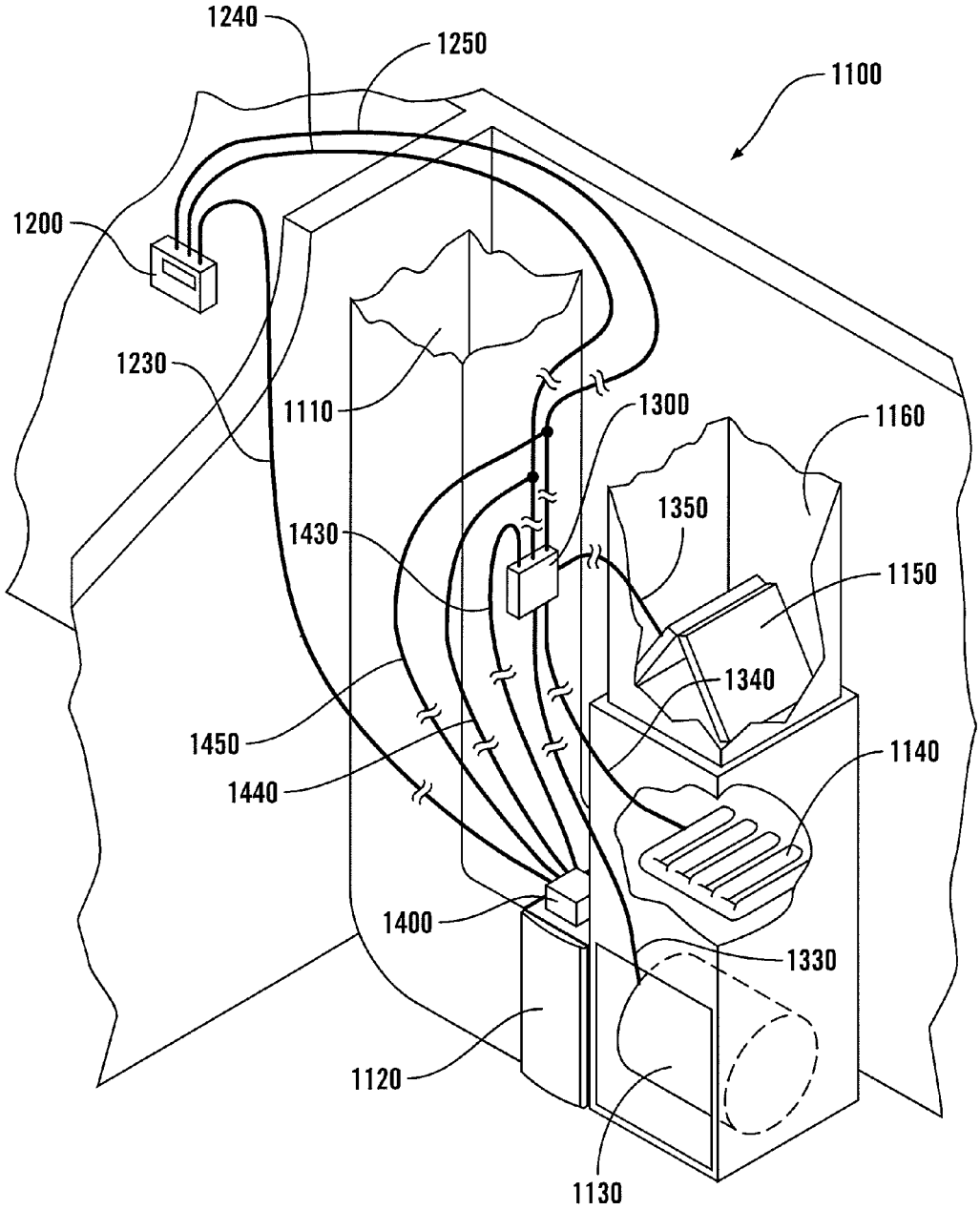
FIG. 2 is a schematic view of a first illustrative embodiment of a heating, ventilation and air conditioning system which incorporates an active air cleaning controller according to this invention.
Figure 3:
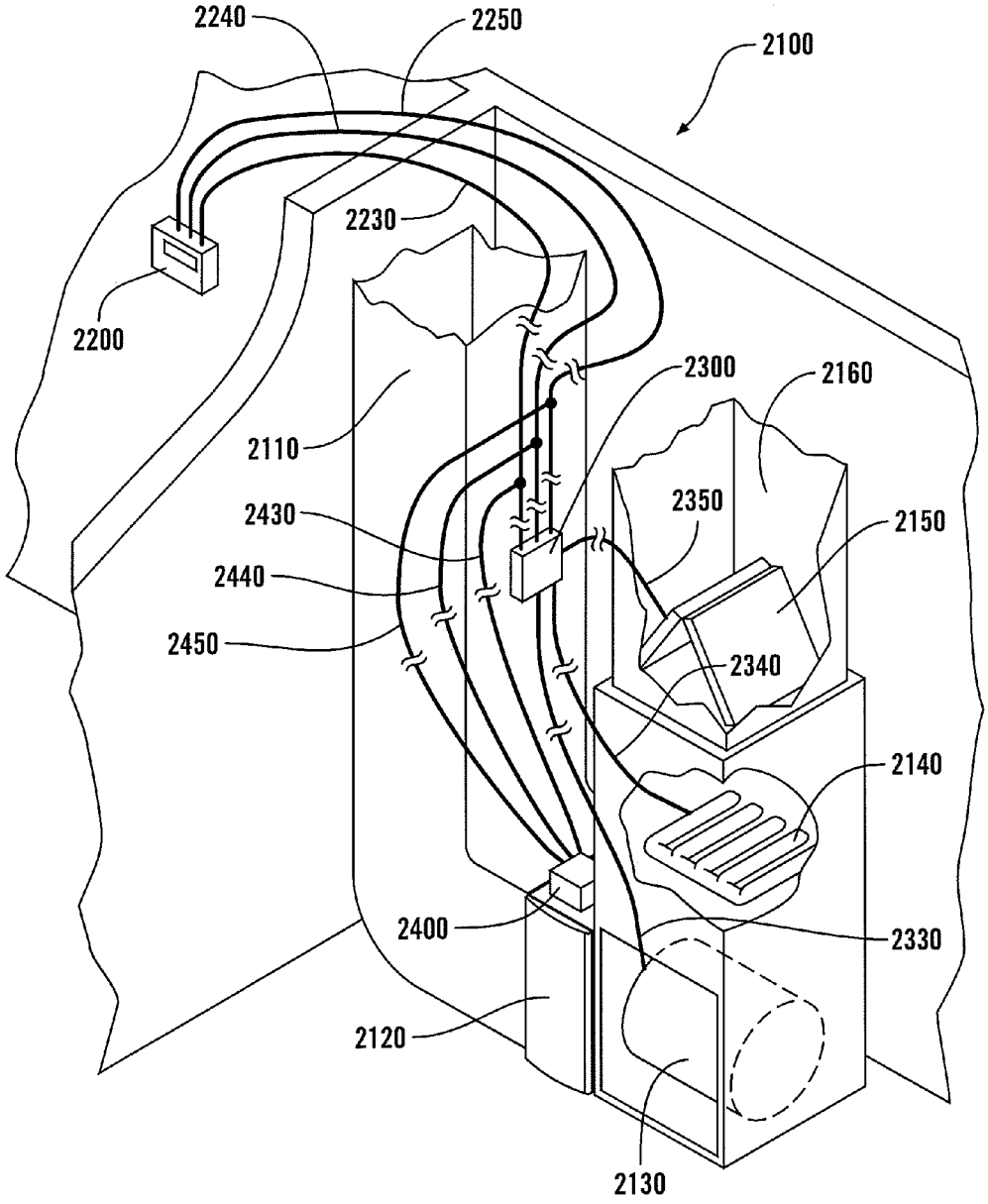
FIG. 3 is a schematic view of a second illustrative embodiment of a heating, ventilation and air conditioning system which incorporates an active air cleaning controller according to this invention.

FIGS. 2 and 3 show two separate exemplary embodiments of an HVAC system 1100 and 2100 with an active air cleaning controller 1400 and 2400, respectively, according to this invention. In the first embodiment shown in FIG. 2, the active air cleaning controller 1400 is attached in series with the blower call line 1230 and in parallel to the heating and cooling unit call lines 1240 and 1250. In contrast, in the second embodiment shown in FIG. 3, the active air cleaning controller 2400 is attached in parallel to each of the blower call line 2230 and the heating and cooling unit call lines 2240 and 2250.

FIG. 2 shows a first illustrative embodiment of an HVAC system 1100 with the active air cleaning controller 1400 according to this invention. As shown in FIG. 2, the HVAC system 1100 includes a return duct 1110, an air cleaning unit 1120, a blower 1130, a heating unit 1140, a cooling unit 1150 and an air supply duct 1160. When the blower 1130 is active, it pulls air from the living environment into the return duct 1110. This air is pulled through the air cleaning unit 1120. Depending on the needs of the environment, the air can be heated by the heating unit 1140 or cooled by the cooling unit 1150. Whether the air is heated, cooled or neither, the air is supplied to the environment through the air supply duct 1160.

The HVAC system 1100 further comprises an HVAC controller 1300, which may be located in a furnace or other HVAC/air handling unit. The HVAC controller 1300 is connected to a thermostat 1200. The thermostat 1200 is connected to the HVAC controller 1300 via a heating unit call line 1240 and a cooling unit call line 1250. The HVAC controller 1300 is connected to the blower 1130 by a control line 1330, to the heating unit 1140 by a control line 1340 and to the cooling unit 1150 by a control line 1350. In contrast to the conventional HVAC system 100 shown in FIG. 1, an upstream blower call line 1230 is not directly connected to the HVAC controller 1300. It should be appreciated that, in place of the thermostat 1200, any other known or later-developed control unit associated with the HVAC system 1100 may be used to place control signals on the blower, heating unit and cooling unit call lines 1230-1250. For example, another such known or later-developed control unit is a zone panel.

In the illustrative embodiment shown in FIG. 2, an active air cleaning controller 1400 is installed as a bypass (i.e., serial) connection between the thermostat 1200 and the HVAC controller 1300 on the upstream blower call line 1230. As shown in FIG. 2, the upstream blower call line 1230 is connected between the thermostat 1200 and the active air cleaning controller 1400, while a downstream blower call line 1430 is connected between the active air cleaning controller 1400 and the HVAC controller 1300. This serial connection allows the active air cleaning controller 1400 to detect blower call signals from the thermostat 1200 on the upstream blower call line 1230 and pass on (e.g., relay) those call signals to the HVAC controller 1300 over the downstream blower call line 1430. Additionally, the active air cleaning controller 1400 can initiate a call on the downstream blower call line 1430 in response to a need for air cleaning at least when no call is being received from the thermostat 1200 on the upstream blower call line 1230, without inadvertently providing that signal to the thermostat 1200 as well. The connections between the active air cleaning controller 1400, the downstream blower call line 1230, the heating unit call line 1240, the cooling unit call line 1250 and the HVAC controller 1300 are shown in greater detail in FIG. 5.

The active air cleaning controller 1400 can also include parallel connections to the heating unit call line 1240 via a parallel connection 1440 and to the cooling unit call line 1250 via a parallel connection 1450. The active air cleaning controller 1400 uses the parallel connections 1440 and 1450 to sense when the thermostat 1200 is requesting that the living unit be heated or cooled and thus activating the blower 1130.

It is also possible that the thermostat 1200 can request that just the blower 1130 be activated by sending a call on the upstream blower call line 1230. This could be in response to a "fan on" setting selected by the user. The active air cleaning controller 1400 uses the information it gathers regarding the status of the upstream blower call line 1230, and possibly the heating call line 1240 and the cooling call line 1250, to determine the amount of time that the blower 1130 has been active and thus pulling air through the air cleaning unit 1120 over a given time period.

For example, if the thermostat 1200 sends a blower call on the upstream blower call line 1230 in addition to a heating or a cooling call on the heating or cooling call line 1240 or 1250, the active air cleaning controller 1400 uses the upstream blower call line 1230 to determine when, and for how long, the blower 1130 is active and thus pulling air through the air cleaning unit 1120. Additionally, in this example, the active air cleaning controller 1400 uses the heating and cooling call lines 1240 and 1250 to differentiate between the "fan-on" setting outlined above, and a call for heating or cooling.

If, for example, the thermostat 1200 does not send a blower call on the upstream blower call line 1230 in addition to a heating or a cooling call on the heating or cooling call lines 1240 or 1250, the active air cleaning controller 1400 uses the upstream blower call line 1230, the heating call line 1240 and the cooling call line 1250 to determine when, and for how long, the blower 1130 has been active. Additionally, in this example, the active air cleaning controller 1400 uses the upstream blower call line 1230 to differentiate between the "fan-on" setting being selected and a call for heating or cooling.

Figure 4A:
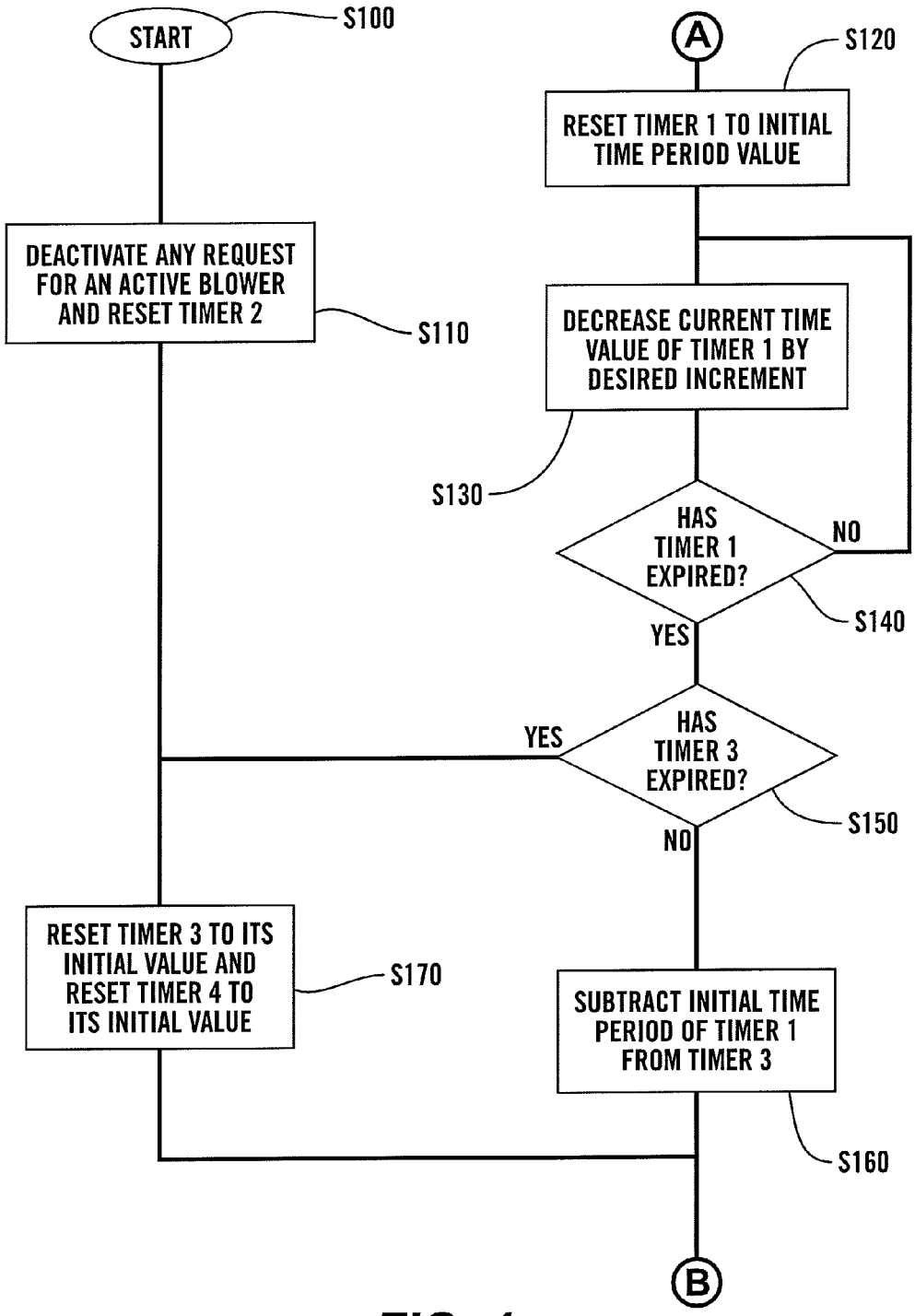
FIGS. 4*a*, 4*b*, and 4*c* are flowcharts outlining one exemplary embodiment of a method for automatically generating a blower call signal to actively pass air from a living environment through an air cleaner of an HVAC system independently of blower calls generated by any other control unit of the HVAC system according to this invention.
Figure 4B:
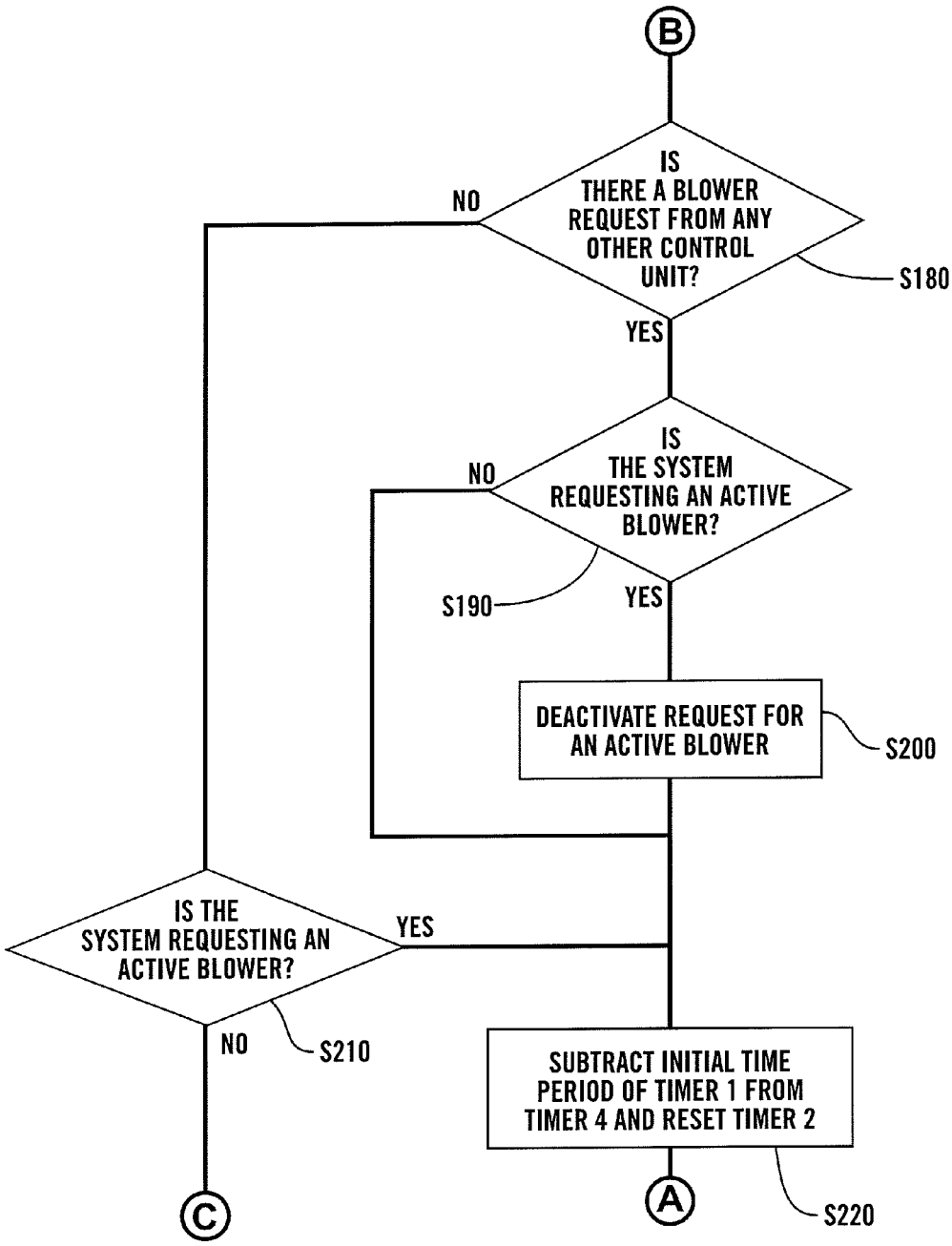
Figure 4C:
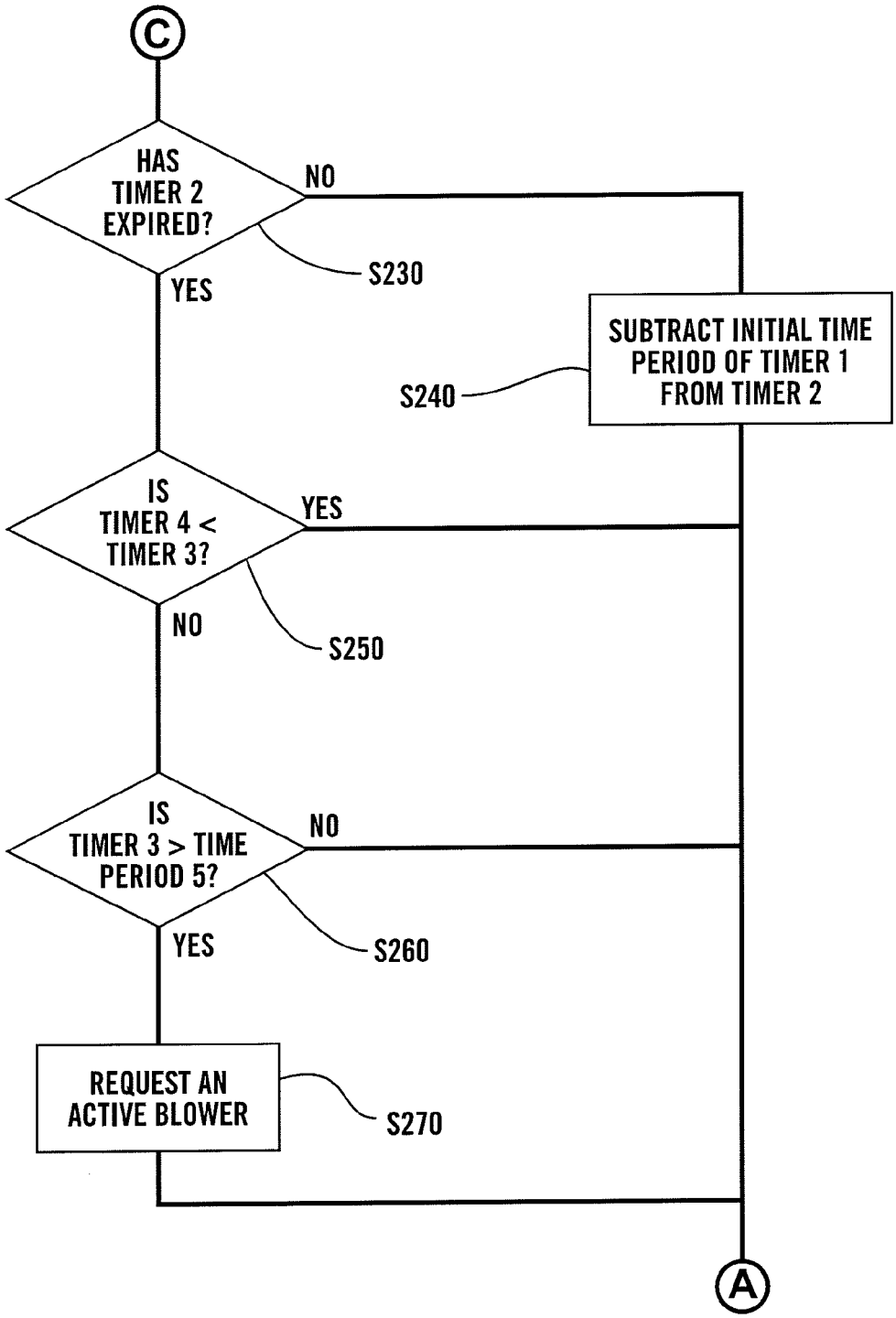

If the upstream blower call line 1230 and the heating and cooling call lines 1240 and 1250 are all inactive, the active air cleaning controller 1400 will decide whether the air has been adequately cleaned, based on user-defined and/or factory-defined settings. If the air has not been adequately cleaned, the active air cleaning controller 1400 will send a blower call to the HVAC controller 1300 on the downstream blower call line 1430. FIG. 4 outlines one exemplary embodiment of a method for generating a blower call based on the amount of time that the blower 1130 has been active.

It should be appreciated that the first embodiment of an active air cleaning controller 1400 described above is particularly useful for an HVAC system which incorporates a thermostat 1200 that does not generate separate signals to send on the blower call line 1230 and the cooling unit call line 1250. That is, such a thermostat 1200 may internally electrically connect the cooling unit call line 1250 to the upstream blower call line 1230. When a call signal is sent on the downstream blower call line 1430 by the active air cleaning controller 1400, the call signal will not be placed on the upstream blower call line by the thermostat 1200 and thus will not be placed onto the cooling unit call line 1250.

It should be appreciated that, while the connections between the active air cleaning controller 1400 and the heating and cooling unit call lines 1240 and 1250, respectively, are shown external to each of the thermostat 1200, the HVAC controller 1300 and the active air cleaning controller 1400, the connections could be internal to any of these devices or the connections could be made by any two of the three devices on the same connection terminal of the third device.

FIG. 3 shows a second illustrative embodiment of an HVAC system 2100 with an active air cleaning controller 2400 according to this invention. Similarly to the embodiments shown in FIGS. 1 and 2, the HVAC system 2100 includes a return duct 2110, an air cleaning unit 2120, a blower 2130, a heating unit 2140, a cooling unit 2150 and an air supply duct 2160. When the blower 2130 is active, it pulls air from the living environment into the return duct 2110. This air is pulled through the air cleaning unit 2120 and then pushed past the heating unit 2140 and the cooling unit 2150 before being supplied to the living environment through the air supply duct 2160. Depending on the needs of the living environment, the air can be heated by the heating unit 2140 or cooled by the cooling unit 2150. Whether the air is heated, cooled or neither, the air is supplied to the environment through the air supply duct 2160.

The HVAC system 2100 further comprises an HVAC controller 2300. The HVAC controller 2300 is connected to the blower 2130 by a control line 2330, to the heating unit 2140 by a control line 2340 and to the cooling unit 2150 by a control line 2350. A thermostat 2200 is connected to the HVAC controller 2300 by a blower call line 2230, which carries call signals to activate the blower 2130; a heating unit call line 2240, which carries call signals to activate the heating unit 2140; and a cooling unit call line 2250, which carries call signals to activate the cooling unit 2150. It should be appreciated that, in place of the thermostat 2200, any other known or later-developed control unit associated with the HVAC system 2100 may be used to place control signals on the blower, heating unit and cooling unit call lines 2230-2250. For example, another such known or later-developed control unit is a zone panel.

In this exemplary embodiment, the active air cleaning controller 2400 has parallel connections 2430, 2440 and 2450 connected to the blower call line 2230, the heating unit call line 2240 and the cooling unit call line 2250, respectively. The active air cleaning controller does not intercept or interrupt any of the connections between the thermostat 2200 and the HVAC controller 2300 because these connections are parallel. However, the active air cleaning controller 2400 is capable of determining the states of the blower 2130, the heating unit 2140 and the cooling unit 2150, via the call lines 2230, 2240 and 2250, respectively, and can initiate a blower call on the blower call line 2230, via the parallel connection 2430, if a blower call is needed or desired and no blower call is currently being sent by the thermostat 2200 to the HVAC controller 2300. The connections between the active air cleaning controller 2400 and the call lines 2230, 2240 and 2250 are shown in greater detail in FIG. 6.

In some exemplary embodiments, the active air cleaning controller 2400 uses the information it gathers regarding the status of the blower 2130, and possibly the heating unit 2140 and the cooling unit 2150, to determine the amount of time that the blower 2130 has been active and thus pulling air through the air cleaning unit 2120 over a given period of time. If there is no call for heating or cooling on the heating call line 2240 or cooling call line 2250 and there is no call on the blower call line 2230, the active air cleaning controller 2400 decides whether the air has been adequately cleaned as determined by user-defined and/or factory-defined settings. If the air has not been adequately cleaned, the active air cleaning controller 2400 will send a blower call on the parallel connection 2430.

As stated above, when the active air cleaning controller 2400 is connected in parallel to the call lines 2230, 2240 and 2250, as shown in FIG. 3, the physical connections can be located anywhere that is electrically connected to the thermostat 2200, the HVAC controller 2300 and the active air cleaning controller 2400. Additionally, the active air cleaning controller 2400 may be a part of either the thermostat 2200 or the HVAC controller 2300.

FIG. 4 is a flowchart outlining one exemplary embodiment of a method for automatically generating, based on the amount of time the HVAC blower is or has been active in a given time period, a blower call signal to actively pass air from a living environment through an air cleaner of an HVAC system, independently of blower calls generated by any other control unit system or device of the HVAC system.

As shown in FIG. 4, when power is initially supplied to, or is restored to, an HVAC system that includes an active blower control, such as the above-outlined active air cleaning controllers 1400 or 2400, according to this invention, operation begins in step S100, and continues to step S110, where any blower calls from the active blower control are deactivated and, a second timer, Timer 2, which represents the "blower off time," is reset to its initial value. Operation then jumps to step S170.

In contrast, step S120 begins a new iteration and is reached upon the conclusion of a previous measurement period. In step S120, a first timer, Timer 1, is reset to an initial time period value. The initial time period value of Timer 1 represents the length of time of one measurement period over which the amount of time of operation of the blower is measured. Next, in step S130, the current time value held by Timer 1 is decreased or decremented by a desired time increment. Typically, Timer 1 is initially set to one minute and the desired increment is one second. Then, in step S140, a determination is made whether Timer 1 has expired, i.e., the current time value held by Timer 1 has reached zero. If so, operation continues to step S150. Otherwise, operation jumps back to step S130.

In step S150, a determination is made whether a third timer, Timer 3, which represents the monitoring period, has expired, i.e., the current time value of Timer 3 is zero. If the monitoring period has ended, the operation jumps to step S170 to initiate a new monitoring period. Otherwise, operation continues to step S160. In step S160, the time left in the monitoring period is decreased by the time of one iteration of the measuring period, the time period value of Timer 1. Operation then jumps to step S180.

In step S170, the third timer and a fourth timer, Timer 3 and Timer 4, are both reset to their respective initial values, so that a new monitoring period can begin. Then, in step S180, a determination is made whether any other control unit of the HVAC system is requesting the blower to be active. If another control unit of the HVAC system is requesting that the blower be active, operation continues to step S190. Otherwise, operation jumps to step S210.

In step S190, a determination is made whether the active blower control system is requesting that the blower be active. If the active blower control system is requesting that the blower be active, operation continues to step S200. Otherwise, operation jumps directly to step S220. In step S200, the request by the active blower control for an active blower is deactivated. Operation then continues to step S220.

It should be appreciated that Timer 3 measures the elapsed time in each monitoring period. More specifically, Timer 3 is a "count-down" timer having an initial time period value that corresponds to the length of the monitoring period. Timer 3 is reset at the beginning of each monitoring period and expires at the end of the monitoring period.

It should also be appreciated that Timer 4 measures the current total blower run time over the current monitoring period. More specifically, Timer 4 is a "count-down" timer that is reset at the beginning of each monitoring period to a desired amount of blower run time over the monitoring period. Thus, the current value of Timer 4 represents the remaining amount of blower run time that the blower needs to be active over the current monitoring period. It should be appreciated that all of the Timers 1-4 are implemented as "count-down" timers, but could just as easily be implemented as "count-up" timers.

In step S210, a determination is made whether the active blower control system is requesting that the blower be active. If so, operation continues to step S220. Otherwise, operation jumps to step S230.

It should be appreciated that, whenever step S220 is reached, the blower is active. The blower is active either in response to a call for heating or cooling from any other control unit of the HVAC system or to a blower call from any other control unit of the HVAC system (step S200) or because the blower remains active from a blower call initiated by the active blower control during a previous iteration of the measurement period (step S210).

Accordingly, in step S220, the time of one iteration of the measurement period, i.e., the time period value of Timer 1, is subtracted from the current value held in Timer 4. This represents that the blower has run for one measurement period. Also in step S220, Timer 2 is reset to its initial value to show that the blower is not off. Operation then jumps back to step S120.

In contrast to step S220, in step S230, a determination is made whether Timer 2 has expired, i.e., the current value held in Timer 2 has reached zero. If not, operation continues to step S240. Otherwise, operation jumps to step S250. If the blower has not been off for a pre-determined amount of time, represented by the initial value of Timer 2, then a request to activate the blower will not be generated. In step S240, the time of one iteration of the measurement period, i.e., the time period value of Timer 1, is subtracted from Timer 2. Operation then again jumps back to step S120.

In contrast to step S240, in step S250, a determination is made whether there is more time left in the monitoring period than there is time of desired cleaning left. If there is less time of desired cleaning left than time left in the monitoring period, operation jumps back to step S120. Otherwise, operation continues to step S260. In step S260, a determination is made whether there is more time left in the monitoring period than a pre-determined time period 5. If there is more time than time period 5 left in the monitoring period, operation continues to step S270. Otherwise, operation jumps back to step S120. In step S270, a request that the blower be activated is initiated. Operation then again jumps back to step S120.

It should be appreciated that time period 5 is used to make sure that the blower will only be activated in response to a need for cleaning if there is sufficient time left in the monitoring period to provide a minimum amount of cleaning. This avoids running the blower for only short cleaning intervals at the end of any monitoring period.

It should be appreciated that some embodiments may not use a Timer 2 to assure that the blower is off for a minimum amount of time before it is turned back on. In such embodiments, Timer 2 will not be reset in any of the above steps and steps S230 and S240 may be omitted. Likewise, some embodiments may not use a time period 5 to assure that the blower will run for at least a minimum amount of time at the end of an operating cycle. In such embodiments step S260 may be omitted.

Figure 5:
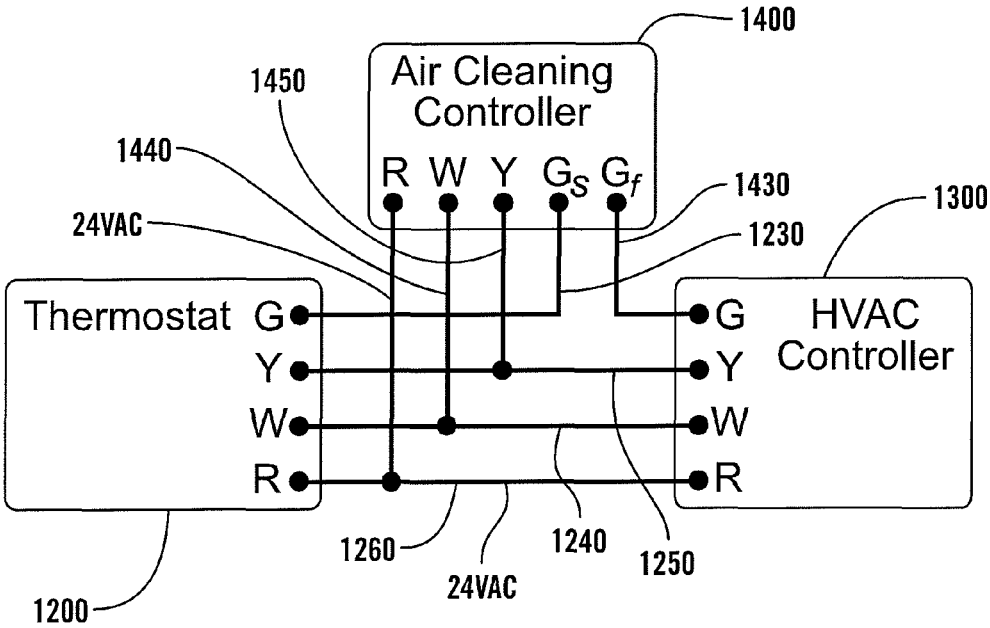
FIG. 5 is a wiring diagram illustrating a first exemplary embodiment for connecting an active air cleaning controller between a thermostat and an HVAC system according to this invention.

FIG. 5 shows the wiring connections between the first embodiments of a thermostat 1200, an HVAC controller 1300 and an active air cleaning controller 1400 of FIG. 2 in greater detail. As shown in FIG. 5, the active air cleaning controller 1400 intercepts the connection between the thermostat 1200 and the HVAC controller 1300 and must relay any call signals from the upstream blower call line 1230 to the downstream blower call line 1430. The HVAC controller 1300 receives all of its blower call signals from the active air cleaning controller 1400, rather than directly from the thermostat 1200. The active air cleaning controller 1400 is able to monitor the presence of signals on the call lines 1230, 1240 and 1250 to determine the state of the blower 1130. The active air cleaning controller 1400 can also activate a call on the downstream blower call line 1430 instructing the HVAC controller 1300 to activate the blower 1130.

In some exemplary embodiments, the active air cleaning controller 1400 will normally act as a pass-through connection to the downstream blower call line 1430 from the upstream blower call line 1230 and will switch in a connection from a 24-VAC R line 1260, to the downstream blower call line 1430, thus disconnecting the upstream blower call line 1230 from the downstream blower call line 1430, in response to a need for air cleaning if there is not a call for an active blower present on the upstream blower call line 1230. It should be appreciated that, in place of the R line 1260, any other 24-VAC line that has the same common as the R line 1260 may be connected by the active air cleaning controller 1400 to the downstream blower call line 1430. It should be appreciated that, in place of the thermostat 1200, any other known or later-developed control unit associated with the HVAC system 1100 may be used to place control signals on the blower, heating unit and cooling unit call lines 1230-1250. For example, another such known or later-developed control unit is a zone panel.

It should be appreciated that, although the active air cleaning controller 1400 is shown in FIGS. 2 and 5 as being connected to each of the call lines 1230, 1240 and 1250, the active air cleaning controller 1400 may only need to use a subset of the call lines 1230, 1240 and 1250 to determine the state of the blower 1130. In such a case, some of the connections between the active air cleaning controller 1400 and the call lines 1230, 1240 and 1250 may be omitted so long as the active air cleaning controller 1400 is capable of determining the state of the blower 1130 and is capable of initiating a call for the blower 1130 to be active.

Figure 6:
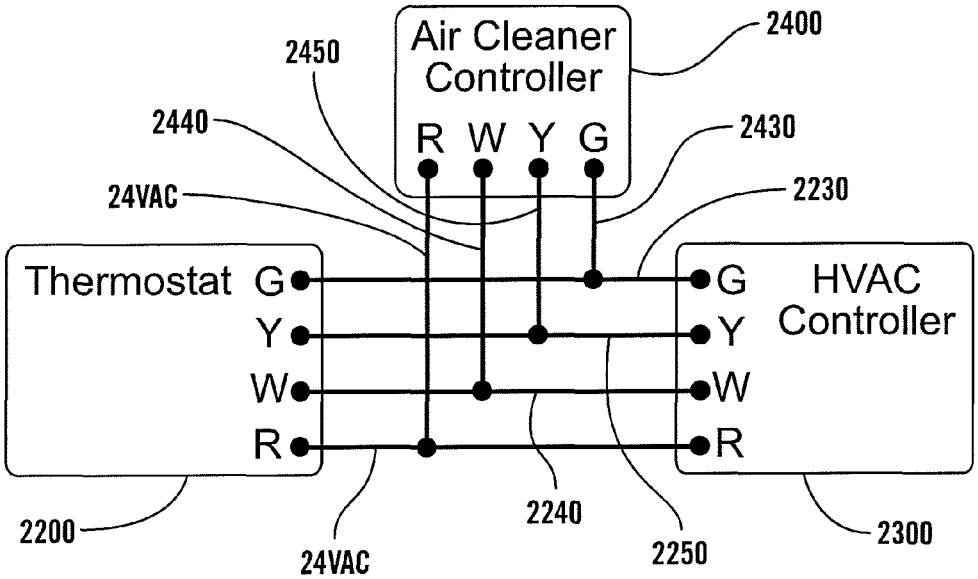
FIG. 6 is a wiring diagram illustrating a second exemplary embodiment for connecting an active air cleaning controller between a thermostat and an HVAC system according to this invention.

FIG. 6 shows the wiring connections between the second embodiments of a thermostat 2200, an HVAC controller 2300 and an active air cleaning controller 2400 of FIG. 3 in greater detail. As shown in FIG. 6, the call lines 2230, 2240 and 2250 between the thermostat 2200 and the HVAC controller 2300 are undisturbed by the active air cleaning controller 2400. The active air cleaning controller 2400 has parallel connections 2430, 2440 and 2450 to the call lines 2230, 2240 and 2250, respectively. The active air cleaning controller 2400 can monitor the presence of signals on the call lines 2230, 2240 and 2250 to determine the state of the blower 2130. The active air cleaning controller 2400 can also activate the blower call line 2230 by sending a call signal on the parallel connection 2430 to activate the blower 2130. It should be appreciated that, in place of the thermostat 2200, any other known or later-developed control unit associated with the HVAC system 2100 may be used to place control signals on the blower, heating unit and cooling unit call lines 2230-2250. For example, another such known or later-developed control unit is a zone panel.

It should be appreciated that, although the active air cleaning controller 2400 is shown in FIGS. 3 and 6 as being connected to each of the call lines 2230, 2240 and 2250, the active air cleaning controller 2400 may only need to use a subset of the call lines 2230, 2240 and 2250 to determine the state of the blower 2130. In such a case, some of the connections between the active air cleaning controller 2400 and the call lines 2230, 2240 and 2250 may be omitted so long as the active air cleaning controller 2400 is capable of determining the state of the blower 2130 and is capable of initiating a call for the blower 2130 to be active.

It should be appreciated that there are HVAC controllers and thermostats that communicate via methods that are different from the binary call line communication protocol described above with respect to the first and second embodiments of an HVAC system that incorporates an active air cleaning controller according to this invention. Any such known or later-developed communication method can be used by a thermostat, an HVAC controller and an active air cleaning controller according to this invention, so long as the active air cleaning controller can determine the state of the blower and can initiate and/or transmit a request for a blower to be active to an HVAC controller. For example, the HVAC controller and thermostat may be two components on a communication bus that uses a number of communication lines to transmit encoded information. In such a case, the active air cleaning controller may also be connected to the communication bus and will decode communications on the bus to determine the status of the blower. Likewise, the thermostat may communicate wirelessly with the HVAC controller. In such a case, the active air cleaning controller may also include a transceiver or a receiver and will translate the wireless communications to determine the state of the blower.

Figure 7:
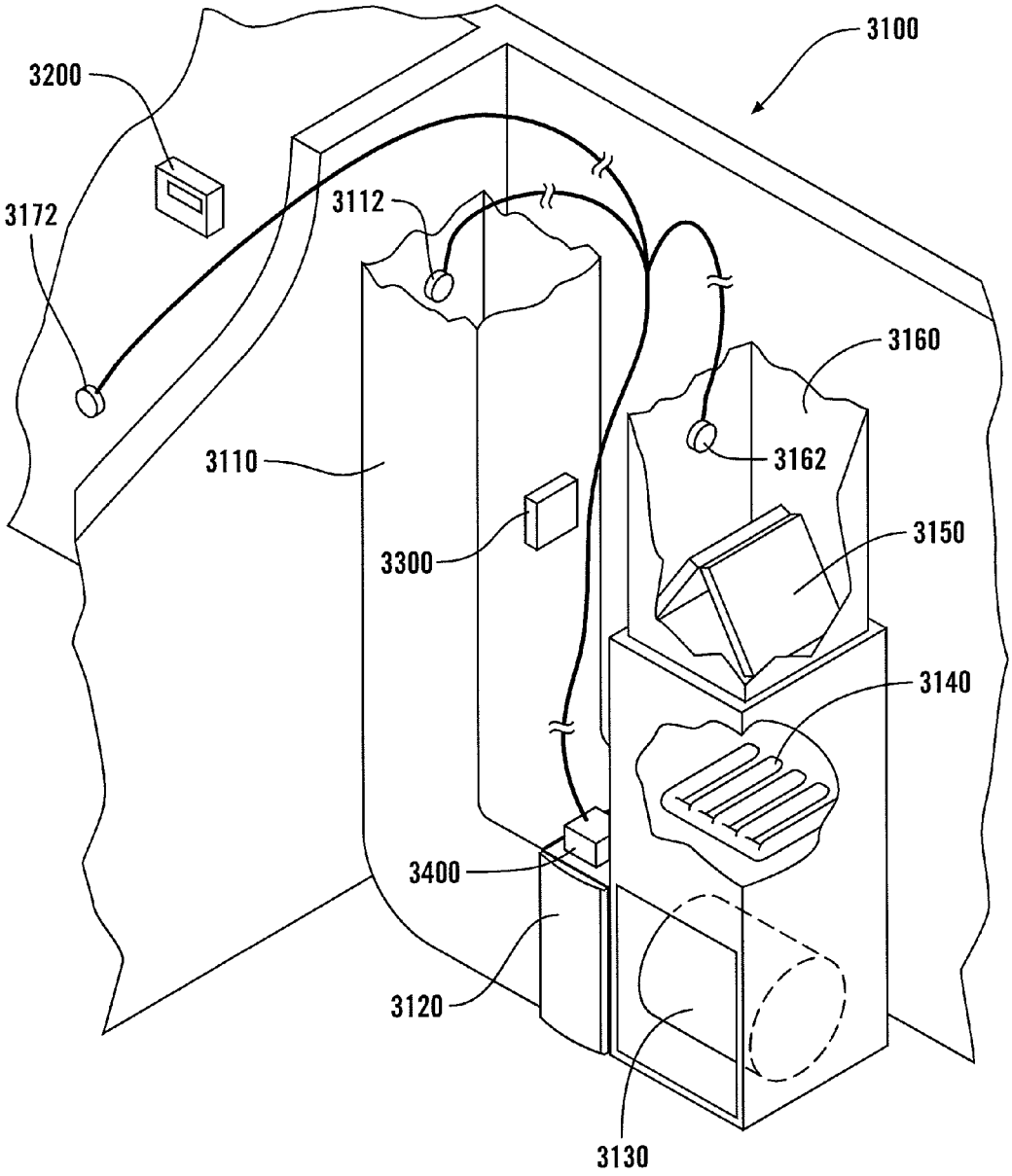
FIG. 7 is a schematic view of an exemplary embodiment of a heating, ventilation and air conditioning system which incorporates an active air cleaning controller with a sensor network according to this invention.

FIG. 7 shows an exemplary embodiment of an HVAC system 3100 that includes one or more sensors located throughout the HVAC system 3100 and/or in the living environment. The HVAC system 3100 has the same components as the HVAC systems shown in FIGS. 1-3, i.e., a return duct 3110, an air cleaning unit 3120, a blower 3130, a heating unit 3140 and/or a cooling unit 3150 and a supply duct 3160, as well as a thermostat 3200 and an HVAC controller 3300.

As shown in FIG. 7, the HVAC system 3100 can include one or more of a sensor, or a series of sensors, 3112 in the return duct 3110, a sensor, or a series of sensors, 3162 in the supply duct 3160 and a sensor, or a series of sensors, 3172 in the living environment. It should be appreciated that the HVAC system 3100 may have zero, one or more sensors in any or all of these locations and that different sensors in a single location may be designed to detect different aspects of air quality. Additionally, there may be sensors 3112, 3162 or 3172 in multiple locations in the return duct 3110, the supply duct 3160 or the living environment.

The sensors 3112, 3162 and 3172 are each electrically connected to, or otherwise in communication with, an active air cleaning controller 3400, which is also connected to the thermostat 3200 and HVAC controller 3300 by any of the above-outlined connection schemes. It should be appreciated that the active air cleaning controller 3400 may be implemented using either of the active air cleaning controllers 1400 or 2400 shown in FIG. 2 or 3, or may be implemented using a completely separate embodiment.

The active air cleaning controller 3400 uses the information collected from any number of the sensors 3112, 3162 and 3172 to determine the environmental conditions of the living environment. For example, one of the sensors 3172 in the living environment may be designed to sense occupancy. The active air cleaning controller 3400 can use the information collected regarding occupancy to, for example, determine that an air cleaning cycle should be initiated.

Likewise, other ones of the sensors 3112, 3162 and/or 3172 located in the return duct 3110, the supply duct 3160 and/or the living environment may be designed to detect the presence of pollutants, allergens, or irritants and/or detect any other desired aspect of air quality. The active air cleaning controller 3400 can use the information collected from the sensors 3112, 3162 and/or 3172 to initiate or alter cleaning programs selected by the user or default programmed. For example, the active air cleaning controller 3400 may lengthen or shorten, either indefinitely or within a desired range, the time period of desired blower run time over a given time period in response to the presence or absence of an occupant, the number of occupants and/or higher or lower levels of pollutants, allergens and/or irritants detected by sensors 3112, 3162 and/or 3172.

Figure 8:
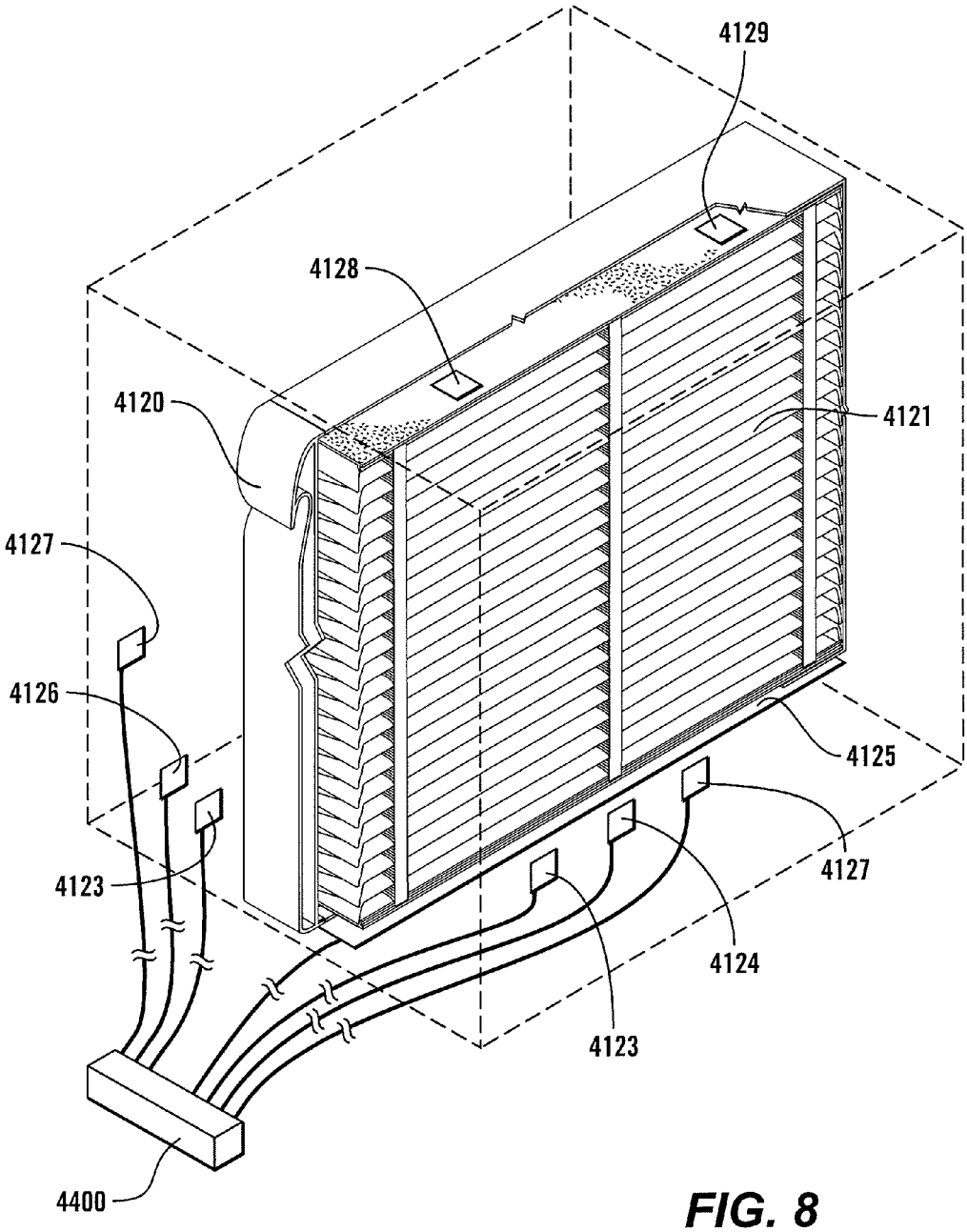
FIG. 8 is a partial cut-away perspective view of an air cleaning unit usable with various embodiments of an active air cleaning controller according to this invention.

FIG. 8 is a partial cut-away perspective view of an air cleaning unit 4120 usable with various embodiments of an active air cleaning controller 4400 according to this invention. It should be appreciated that the air cleaning unit 4120 may be one component of a larger HVAC system similar to any of the HVAC systems 1100, 2100 or 3100 described above or a separate embodiment of an HVAC system. It should also be appreciated that a first return duct portion and a second return duct portion are attached to the air cleaning unit 4120 such that the air cleaning unit 4120 is inline with the flow of air that is pulled from an environment through the return duct portions and the air cleaning unit 4120 by a blower and supplied back to the environment through a supply duct.

In this embodiment of an active air cleaning controller 4400, the air cleaning unit 4120 uses a replaceable filter 4121. The replaceable filter 4121 should be replaced on a regular and/or adjustable schedule according to the environment serviced by the air cleaning unit 4120 and the active air cleaning controller 4400. Timely replacement of the replaceable filter 4121 is desirable to assure that the air cleaning unit 4120 is effectively and efficiently cleaning air that passes through the air cleaning unit 4120. To assist the user in determining when the replaceable filter 4121 should be replaced, the air cleaning unit 4120 and/or the active air cleaning controller 4400 are equipped with and/or include one or more sensors, including one or more of at least one timer, one or more pressure sensors 4123, one or more airflow sensors 4124, one or more scales 4125, one or more optical sensors 4126, one or more particle counting sensors 4127 one or more ohmmeters 4128 and/or one or more other known or later-developed sensors that may be helpful in determining the approximate age, amount of use or present effectiveness of the replaceable filter 4121.

It should be appreciated that any number of the one or more timers and/or the one or more sensors 4123, 4124, 4125, 4126, 4127, 4128 and/or 4129 may be used individually or in coordination with each other. Likewise, it should be appreciated that the sensors 4123-4129 may be individual sensors or a series of sensors and that these sensors may be located in the same location or different locations inside of, in contact with, adjacent to, or outside of the air cleaning unit 4120. Further, the sensors 4123-4129 may communicate with the active air cleaning controller 4400 using any suitable known or later-developed method, such as, for example, RF communication or any other known or later-developed wired or wireless communication method.

The one or more timers may be separate from the active air cleaning controller 4400, or may be integrated into the active air cleaning controller 4400. The one or more timers track the cumulative operating time of the blower that moves air through the air cleaning unit 4120 to determine the amount of use, or the like, of the replaceable filter 4121. Alternatively, the one or more timers may be used to measure the actual age of the replaceable filter 4121 to determine an expiration date of the replaceable filter 4121. That is, the replaceable filter 4121 may be assumed to be in need of replacement after a predetermined length of time even though there may not be any other indication that the replaceable filter 4121 needs to be replaced.

The one or more pressure sensors 4123 can also be used to determine the amount of remaining useful life, the amount of use and/or the effectiveness of the replaceable filter 4121. The one or more pressure sensors 4123 may be placed on either or both sides of the replaceable filter 4121 to measure the air pressure on either or both sides of the replaceable filter 4121 and/or to determine a pressure drop across the replaceable filter 4121. For example, as shown in FIG. 8, one such pressure sensor 4123 can be placed on each side of the replaceable filter 4121. The active air cleaning controller 4400 then determines that the replaceable filter 4121 should be replaced if the pressure drop across the replaceable filter 4121 rises above a predetermined limit.

Similarly, the one or more airflow measuring sensors 4124 can be placed on either or both sides of the replaceable filter 4121. The airflow measuring sensor(s) 4124 may be used to determine the air flow on either or both sides of the replaceable filter 4121 and/or may be used to determine the difference between the rates of airflow on the two sides of the replaceable filter 4121. For example, as shown in FIG. 8, one airflow sensor 4124 can be used to determine that the replaceable filter should be replaced if the rate of airflow as the air exits the air cleaning unit 4120, as measured by an airflow sensor 4124 on the exiting side of the replaceable filter 4121, falls below a predetermined limit.

The scale 4125 can also be used to determine the amount of remaining useful life, the amount of use and/or the effectiveness of the replaceable filter 4121. The scale 4125 may measure the mass of the replaceable filter 4121. As more particles collect on the replaceable filter 4121, the mass of the replaceable filter 4121 rises. When the mass of the replaceable filter 4121 rises above a predetermined limit, the active air cleaning controller 4400 determines that the replaceable filter 4121 needs to be replaced.

The one or more optical sensors 4126 may be paired with a light source or rely on ambient lighting to measure the opacity of the replaceable filter 4121 and/or the optical sensor 4126 may detect particles that fluoresce at particular wavelengths. It should be appreciated that the optical sensor 4126 may be designed to operate at any one or multiple wavelengths and may be paired with one or more light sources that are appropriate for those wavelength(s). For example, certain particles which collect on the replaceable filter 4121 may fluoresce at or absorb a particular first wavelength better than or worse than the filter media, while the filter media itself and/or other particles fluoresce at or absorb a particular second wavelength better or worse than each other and/or better or worse than the first particles. In this case, the optical sensor 4126 may be paired with a light source appropriate for the first wavelength and a light source appropriate for the second wavelength, such that the optical sensor can detect an amount of fluorescence at or absorption at the particular wavelengths. The active air cleaning controller 4400 may then determine whether the replaceable filter 4121 should be replaced based in part on the level or density of particles determined by the varying levels of fluorescence and/or absorption detected by the optical sensor 4126.

The one or more particle counting sensors 4127 may be used to detect the presence of particles on either or both sides of the replaceable filter 4121 to determine the amount of remaining useful life, the amount of use and/or the effectiveness of the replaceable filter 4121. For example, the active air cleaning controller 4400 may use one or more particle counting sensors 4127 to count the number of particles striking the replaceable filter 4121 and will determine that the replaceable filter 4121 needs to be replaced when the number of counted particles rises to a predetermined limit.

The one or more ohmmeters 4128 may be used to measure the electrical resistance between two points on the replaceable filter 4121 to detect the collection of particles on replaceable filter 4121 to assist in determining whether the replaceable filter 4121 should be replaced. For example, if certain particles which collect on the replaceable filter 4121 as air passes through the air cleaning unit 4120 are found to be more or less conductive of electricity than the replaceable filter 4121 itself or a conductive patch provided on the replaceable filter 4121, then measuring the electrical resistance between two points on the replaceable filter 4121 or the conductive patch can be used to determine the approximate accumulation of those particles on the replaceable filter 4121 or the conductive patch. The active air cleaning controller 4400 can then use that information to determine whether the replaceable filter 4121 should be replaced.

Similarly, the one or more ultrasonic sensors 4129 may be used to detect the collection of particles on the replaceable filter 4121. For example, ultrasonic waves may be transmitted from one point on the replaceable filter 4121 and received at another point on the replaceable filter 4121 or passed entirely through the replaceable filter 4121. The disturbances in the travel time of the ultrasonic wave, the shape of the received wave compared with the original wave, or any other appropriate parameter of the ultrasonic wave can be used to determine the amount of matter that the wave passed through. The replaceable filter 4121 may be determined to be in need of replacement if a certain amount of particles are detected by ultrasonic wave.

It should be appreciated that any other known or later-developed sensor that can detect a quality of the replaceable filter 4121 that changes over time due to an amount of use and/or that is related to the effectiveness of the replaceable filter 4121 can be used by the active air cleaning controller 4400 to determine whether the replaceable filter 4121 should be replaced. It should also be appreciated that the sensors 3112, 3162 and/or 3172 shown in FIG. 7 can be used along with or in place of the one or more timers and/or the one or more sensors 4123, 4124, 4125, 4126, 4127, 4128 and/or 4129 to assist in determining when the replaceable filter 4121 should be replaced.

For example, the needs of the living environment may require the replaceable filter 4121 to be changed more or less frequently in response to higher or lower concentrations of pollutants, allergens and or irritants detected by sensors 3112, 3162 and/or 3172. For example, if the sensors 3112, 3162 and/or 3172 detect a high level of pollutants present in the environment serviced by the active air cleaning controller 4400, then the active air cleaning controller 4400 may determine that the replaceable filter 4121 should be replaced after a shorter amount of runtime measured by the one or more timers than if the sensors 3112, 3162 and/or 3172 had detected a low level of pollutants.

It should also be appreciated that the active air cleaning controller 4400 may use any combination of the one or more timers and/or any number of the sensors 4123, 4124, 4125, 4126, 4127, 4128 and/or 4129 to determine whether the replaceable filter 4121 should be replaced. For instance, if the timer indicates that the blower has been used for a longer than desired time, but particle counting sensors 4127 indicate that the replaceable filter 4121 is still effectively removing particles from the air, the active air cleaning controller 4400 may determine that the replaceable filter 4121 does not yet need to be replaced. In general, the active air cleaning controller 4400 may determine that the replaceable filter 4121 should be replaced based on a hierarchy of importance among the one or more timers and/or any of the one or more sensor 4123-4129 that are used by the active air cleaning controller 4400.

Alternatively, the active air cleaning controller 4400 may be configured such that any of the sensors 4123-4129 that are being used have equal importance. In such a case, if any one of the one or more sensors 4123-4129 indicates a situation that the active air cleaning controller 4400 determines to mean that the replaceable filter 4121 needs to be replaced, then the active air cleaning controller 4400 will indicate that the replaceable filter 4121 should be replaced.

It should also be appreciated that the type and/or style of the replaceable filter 4121 currently being used may affect the determination by the active air cleaning controller 4400 of whether or when the replaceable filter 4121 should be replaced. If, for example, a high capacity or extended runtime filter is installed, the active air cleaning controller 4400 may not indicate to the user that the high capacity or extended runtime filter needs to be replaced as quickly as the active air cleaning controller 4400 would with the standard replaceable filter 4121. The type and/or style of the replaceable filter 4121 currently being used may be determined automatically by the active air cleaning controller 4400 or the user may be required to inform the active air cleaning controller 4400 of the type and/or style of the replaceable filter 4121 being used. This may be done by a user defined setting change in the active air cleaning controller 4400.

In various exemplary embodiments, if the active air cleaning controller 4400 determines that the replaceable filter 4121 needs to be replaced, one or more notifications, such as a warning message, a warning light and/or an audible alarm, will be activated. The warning message, warning light and/or alarm may be located on the active air cleaning controller 4400 or the housing for the replaceable filter 4121. Alternatively, the active air cleaning controller 4400 may use another control unit, such as the thermostats 2200 or 3200 or a zone panel, to inform the user that the replaceable filter 4121 needs to be replaced.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A method for automatically controlling a blower of an HVAC system, comprising:

monitoring at least a first call line connected to the HVAC system from a control unit of the HVAC system for a presence or an absence of a blower call signal on at least the first call line over a given monitoring time period;

determining an amount of total run time that the blower of the HVAC system has been active in response to the presence or absence of the blower call signal on at least the first call line of the HVAC system over a given measurement time period throughout the given monitoring time period;

determining if an amount of time left in the monitoring period is greater than zero;

reducing, if the amount of time left in the monitoring period is greater than zero, the amount of time left in the monitoring period by an initial time of the given measurement period;

determining an amount of remaining run time that the blower of the HVAC system is desired to be active during the given monitoring period;

determining if the amount of reduced time left in the monitoring period is greater than the remaining run time that the blower of the HVAC system is to be active; and activating, if the amount of reduced time left in the monitoring period is not greater than the determined amount of remaining run time that the blower of the HVAC system is to be active, the blower of the HVAC system.

2. The method of claim 1, wherein activating the blower of the HVAC system comprises sending a call signal across a call line connected to the HVAC system.

3. The method of claim 1, further comprising:

waiting a first time period after a call for cooling before activating the blower of the HVAC system.

4. A method for automatically controlling a blower adapted to clean air comprising:

monitoring a state of the blower over a given monitoring time period;

determining a current cumulative length of blower operation during a given measurement time period throughout the given monitoring time period;

determining if an amount of time left in the monitoring period is greater than zero;

reducing, if the amount of time left in the monitoring period is greater than zero, the amount of time left in the monitoring period by an initial time of the given measurement period:

determining an amount of desired remaining blower runtime based on the current cumulative length of blower operation and a desired minimum length of blower operation;

activating the blower if the amount of desired remaining blower runtime is at least as long as an amount of time remaining in the monitoring time period.

5. The method of claim 4, wherein monitoring a state of the blower over a monitoring time period comprises monitoring at least one call line from a control system at least indirectly connected to the blower.

6. The method of claim 5, wherein monitoring at least one call line of a control system at least indirectly connected to the blower comprises monitoring at least one of a heating call line, a cooling call line and a blower call line of an HVAC system.

7. The method of claim 6, wherein the control system at least indirectly connected to the blower is a zone panel of an HVAC system associated with the blower.

8. The method of claim 5, wherein the control system at least indirectly connected to the blower is a thermostat of an HVAC system associated with the blower.

9. A controller system for a blower adapted to actively clean air, comprising:

an active air cleaning controller in communication with an HVAC controller and a thermostat, wherein the active air cleaning controller includes a first timer, which represents a remaining time of a blower run time monitoring time period, and a second timer, which represents a remaining runtime of the blower; and an HVAC blower in operable communication with the HVAC controller, wherein the active air cleaning controller activates the HVAC blower if the remaining runtime of the blower is not less than the remaining time of the blower run time monitoring time period.

10. The controller system of claim 9, wherein the second timer responds to call signals on at least one of a heating call line, a cooling call line and a blower call line to track at least one of the cumulative runtime of the blower and the remaining runtime of the blower.

11. The controller system of claim 9, wherein:

the first timer is a count-up timer that tracks an elapsed time of the first time period; and the second timer is a count-up timer that tracks a cumulative runtime of the blower.

12. The controller system of claim 9, wherein:

the first timer is a count-down timer that tracks the remaining time of the first time period; and the second timer is a count-down timer that tracks a remaining runtime of the blower.

13. The controller system of claim 9, further comprising an air cleaning unit in operable communication with the HVAC blower.

14. The controller system of claim 13, wherein the air cleaning unit is in operable communication with the active air cleaning controller.

15. The controller system of claim 9, wherein the HVAC controller is in direct communication with the thermostat.

16. A method of automatically controlling a blower to clean air through an HVAC system, comprising:

monitoring a first call line from a control unit of the HVAC system for a presence or an absence of a blower call signal on the first call line over a given monitoring time period;

determining an amount of accumulated run time that the blower of the HVAC system has been active in response to the presence or absence of the blower call signal on the first call line of the HVAC system over a given measurement time period throughout the given monitoring time period;

determining if an amount of time remaining in the monitoring time period has expired;

reducing, if the amount of time left in the monitoring period has not expired, the amount of time left in the monitoring period by an initial time of the given measurement period;

determining a remaining amount of desired blower runtime in the reduced monitoring time period;

determining if the amount of time left in the reduced monitoring period is greater than the remaining run time that the blower is to be active; and activating the blower if the remaining amount of desired blower runtime is not less than the remaining time of the reduced monitoring period.

17. The method of claim 16, wherein the activating step further comprises:

determining if the remaining time of the reduced monitoring period is greater than a pre-determined minimal blower operation time period; and activating the blower if the remaining time of the reduced monitoring period is not less than the pre-determined minimal blower operation time period.

* * * * *

UNITED STATES PATENT AND TRADEMARK OFFICE

CERTIFICATE OF CORRECTION

PATENT NO. : 8,146,376 B1
APPLICATION NO. : 12/353852
DATED : April 3, 2012
INVENTOR(S) : Williams et al.

It is certified that error appears in the above-identified patent and that said Letters Patent is hereby corrected as shown below:

In the Specification:
In Column 6, Line 22, delete "thermostat 200 will" and insert -- the thermostat 200 will --, therefor.

In the Claims:
In Column 17, Line 63, in Claim 4, delete "period:" and insert -- period; --, therefor.

Signed and Sealed this
Tenth Day of December, 2013

Margaret A. Focarino

Margaret A. Focarino
*Commissioner for Patents of the United States Patent and Trademark Office*